US006263576B1

(12) United States Patent
Drapak et al.

(10) Patent No.: US 6,263,576 B1
(45) Date of Patent: Jul. 24, 2001

(54) ANGLED HAND-HELD RAZOR

(76) Inventors: Joseph Drapak, 5517 W. Sunnyside, Chicago, IL (US) 60630; Paulette Sanders, 5711 N. Spaulding, Chicago, IL (US) 60659

( * ) Notice: Subject to any disclaimer, the term of this patent is extended or adjusted under 35 U.S.C. 154(b) by 0 days.

(21) Appl. No.: 09/390,759

(22) Filed: Sep. 7, 1999

Related U.S. Application Data

(60) Provisional application No. 60/103,584, filed on Oct. 9, 1998.

(51) Int. Cl.[7] ..... B26B 21/14
(52) U.S. Cl. ..... 30/48; 30/77; 30/50
(58) Field of Search ..... 30/47, 48, 50, 30/77; D28/46

(56) References Cited

U.S. PATENT DOCUMENTS

| | | | | |
|---|---|---|---|---|
| D. 258,016 | | 1/1981 | Pace . | |
| D. 282,878 | | 3/1986 | Skidmore . | |
| 794,934 | | 7/1905 | Gaylor . | |
| 1,180,963 | | 4/1916 | Ashwell . | |
| 1,824,338 | * | 9/1931 | Finn | 30/48 |
| 1,979,404 | * | 11/1934 | Pautler | 30/48 |
| 2,073,713 | | 3/1937 | Siegel . | |
| 2,169,574 | | 8/1939 | Wennmann . | |
| 2,342,558 | * | 2/1944 | Schjotz | 30/48 |
| 3,597,841 | * | 8/1971 | Miller | 30/48 |
| 4,128,937 | | 12/1978 | Adorney . | |
| 4,335,509 | | 6/1982 | Smith . | |
| 4,663,843 | | 5/1987 | Savage . | |
| 4,791,724 | | 12/1988 | Dumas . | |
| 5,012,578 | * | 5/1991 | Siefer | 30/48 |
| 5,343,622 | | 9/1994 | Andrews . | |
| 5,526,568 | | 6/1996 | Copelan . | |

FOREIGN PATENT DOCUMENTS

| | | | | |
|---|---|---|---|---|
| 534434 | * | 3/1941 | (GB) | 30/48 |
| 628331 | * | 8/1949 | (GB) | 30/48 |
| 296510 | * | 5/1932 | (IT) | 30/48 |
| 456027 | * | 3/1950 | (IT) | 30/48 |

* cited by examiner

*Primary Examiner*—Hwei-Siu Payer
(74) *Attorney, Agent, or Firm*—Adrienne B. Naumann, Esq.

(57) ABSTRACT

My improved hand-held razor ensures smoother hair removal on any human body part and even on furry domestic animals. The angled or precut blade or blades in the razor head result in angled orientations instead of straight across the longitudinal length of the razor head. The angle of the blade(s) provides a slicing motion which is less likely to tear hair roots and make infection of pores more probable.

4 Claims, 6 Drawing Sheets

FIG. 9a
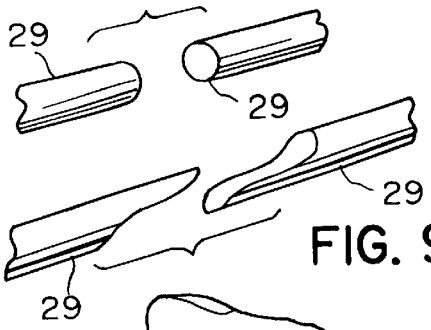
FIG. 9b
FIG. 9c
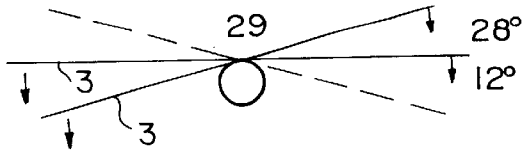
FIG. 10a
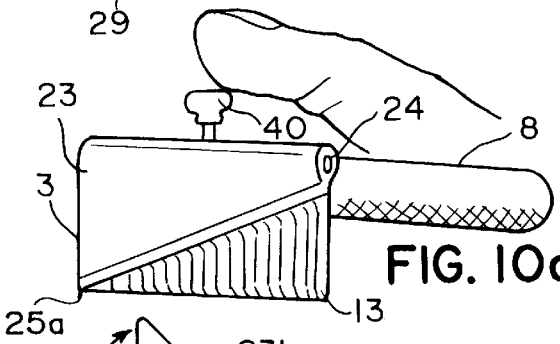
FIG. 10b
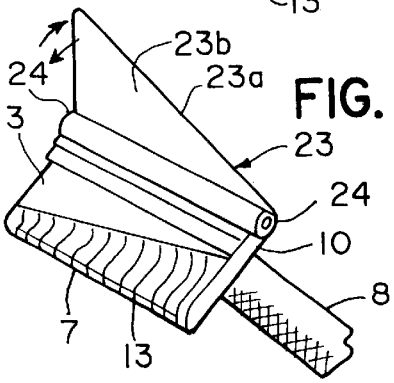
FIG. 11
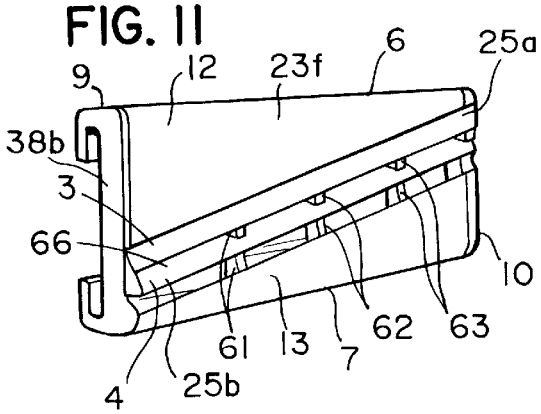
FIG. 12
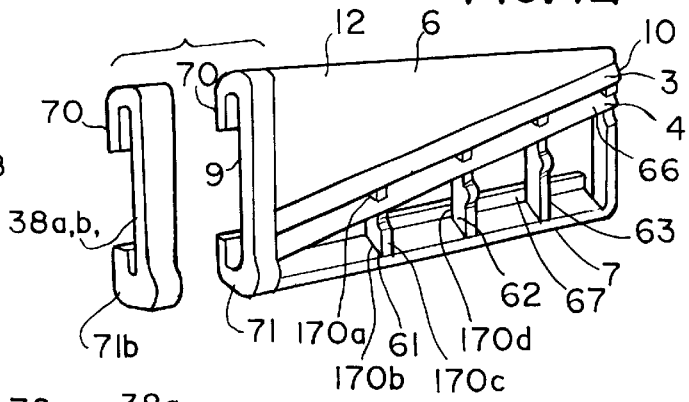
FIG. 13a
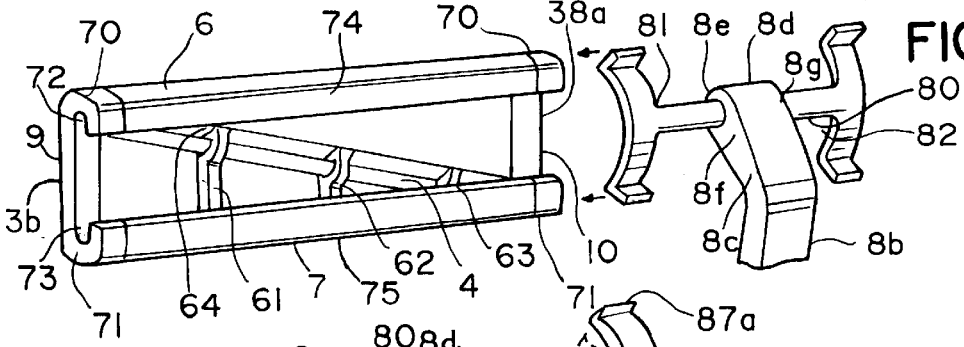
FIG. 13b
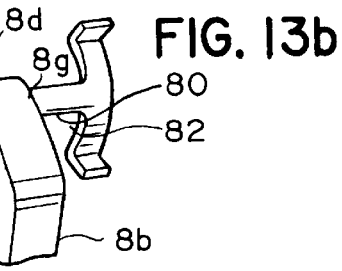
FIG. 13c
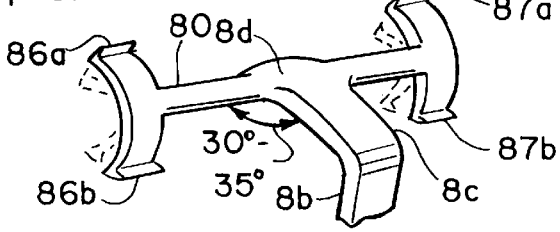

ANGLED HAND-HELD RAZOR

This application is a continuation of provisional application No. 60/103,584 Oct. 9, 1998.

BACKGROUND OF THE INVENTION

My invention relates to a hand-held razor for cutting hair at an angle from the user's skin. More particularly, my invention relates to a hand-held device for cutting hair or other fine follicle like fibers at an acute angle, thereby avoiding damage to the skin or other fine surface. My invention can have one, two or three blades in what appears superficially to be a conventional handheld razor. However, one blade oriented toward the center of a transverse rectangular razor head is preferred.

A variety of shaving instruments for hair, either human or animal are ubiquitous in the prior art. These instruments commonly have a hardened plastic-like shaving head which supports one or more blades along a longitudinal axis of a rectangular razor head. The blade edges are generally held at a specific cutting angle and the blade cuts at approximately a ninety degree angle to the skin surface. The result is a residual force on each hair which rips at the root in each hair follicle, and tends to abrade the skin.

U.S. Pat. No. 4,663,843 (Savage) discloses a shaving razor with at least one leading blade for primary shaving. The cutting edge of the leading blade is aligned diagonally to the cutting edge of at least one trailing blade.

Savage requires more than one blade and does not contain a guard against nicks and cuts.

U.S. Pat. No. 5,526,568 (Capeline) discloses a razor with a conventional disposable razor blade unit and a joint that allows the blade unit to be held at the perpendicular position or a specific oblique angle. There is a switching mechanism controlled manually with a safety brake. U.S. Pat. No. 5,343,622 (Andrews) discloses two pair of narrow, strip-like razor blades embedded in the razor head. One pair extends in a direction opposite from the first pair, and at an acute angle relative to the first pair. The blades extend along the length of the head.

U.S. Pat. No. 4,791,724 (Dumas) discloses a razor body comprises dual razor heads what are adjusted from a wedge-shaped position to a straight edge position by manual pressure. U.S. Pat. No. 4,128,937 (Adorney) discloses a blade's cutting edge at an acute angle so that no part of the blade extends beyond the other end of the handle assembly.

U.S. Pat. No. 4,335,509 (Smith) discloses a cutting device in which the ends of the blade project beyond the sides of the shank. The blades terminate at an oblique cutting edge extending across the width of the blade. U.S. Pat. No. 2,169,574 (Wennmann) discloses a safety razor with thin double-edged blades.

U.S. Pat. No. 2,073,713(E. Siegel) discloses a razor blade having a straight cutting edge and a holder which curves the blade in congruently with a conically curve surface. A taper runs with the direction of extension of a cutting edge of the blade.

None of the above prior art contains my comprehensive variety of upgrades to the traditional handheld razor.

SUMMARY OF THE INVENTION

My new razor comprises a handle and a razor head containing at least one blade. The entire device can be injection molded as one inexpensive handle and head with a stainless steel blade. In the most preferred embodiment, one single-edged trapezoidal stainless steel blade is irreversibly inserted into a rectangular razor head. This trapezoidal blade creates an angle of approximately twenty degrees to the bottom or top longitudinal edge of the razor head.

Immediately adjacent to the slot is the area of the razor head known as the guard, and is another upgrade of my invention. In addition to the angled orientation of the razor blade edge or edges, it prevents additional nicks or cuts.

Accordingly, one of the objects of my invention is to prevent disruption of the hair follicle system on any skin surface by a hand-held razor.

Another object of my invention is to prevent inadvertent nicks and cuts by providing a guard area on the razor head.

Still another object of my invention is to provide a razor head, in which a slot and support bars accept one or more single edged trapezoidal blades so that the blade(s) forms an acute angle with either longitudinal side of a rectangular razor head.

Yet another object of my invention is to orient the blade within the angled razor head slot so that the user cannot inadvertently manually adjust the shaving angle to 90 degrees.

These and other embodiments and features of my invention are disclosed and discussed in the Detailed Discussion of the Invention, infra.

BRIEF DESCRIPTION OF THE DRAWINGS

FIG. 2(*b*): Front view of razor head illustrating handle attachment, single razor edge and guard.

FIG. 2(*c*): Front cutaway portion of razor head in preferred embodiment illustrating support bars behind guard position(not shown).

FIG. 2(*d*): Posterior view of preferred razor head showing support bars and singled edged trapezoidal razor blade in cross section.

FIG. 2(*e*): Top plan view of prior art disposable razor head showing slot for one single-edged rectangular blade.

FIG. 2(*f*): Top plan view of modified razor head, illustrating structure of slot which receives one single-edge trapezoidal blade.

FIG. 6(*b*): Top plan view of trapezoidal single-edge blade for preferred embodiment.

FIG. 6(*c*): Schematic representation of how single edged trapezoidal blade inserts into slot within razor head in preferred embodiment.

FIG. 7(*b*): Trapezoidal singled-edged beveled hinged blade.

FIG. 8(*b*): Partial front view of razor head with end cover and three angled trapezoidal razor blades.

FIG. 9(*a*): Schematic view of dragging motion of horizontal (non-angled) razor blade.

FIG. 9(*b*): Schematic view of slicing motion of angled razor blade.

FIG. 9(*c*): Schematic view of an angled blade slicing a single hair in cross-section.

FIG. 10(*a*): One edged trapezoidal razor within rectangular razor head with blade cover and spring attachment.

FIG. 10(*b*): Trapezoidal singled-edged razor blade with hinge member and shield cover.

FIG. 11: Partial front view of razor head with two trapezoidal singled-edged blades with rigid vertical support space bars.

FIG. 12: Partial front plan view of razor head in cutaway section revealing support space bars and frame.

FIG. 13(*a*): Posterior cutaway view of razor head showing vertical support space bars and posterior of trapezoidal single edged razor blades.

FIG. 13(*b*): Posterior view of handle with flexible prongs.

FIG. 13(*c*): Posterior view of handle with attachment to stem.

FIG. 15(*b*): Upper plan view of rectangular doubled-edged blade with shield removed.

FIG. 15(*c*): Partial upper plan view of one rectangular disposable double-edged blade inserted at an angle within a reusable razor head.

FIG. 15(*d*) Schematic representation of how doubled-edge rectangular razor blade is inserted into razor head and razor head is attached to handle.

DETAILED DESCRIPTION OF THE INVENTION IN ITS PREFERRED EMBODIMENT AND OTHER EMBODIMENTS

Figure 1A:
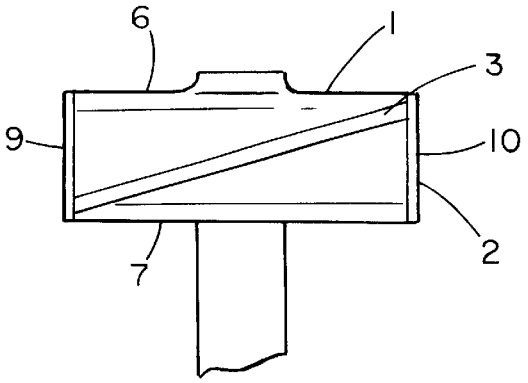
FIG. 1(*a*)(*b*)(*c*): Front partial views of new razor head with one singled edged blade(a), two singled-edged blades (b), and three single-edged blades(c).
Figure 1B:
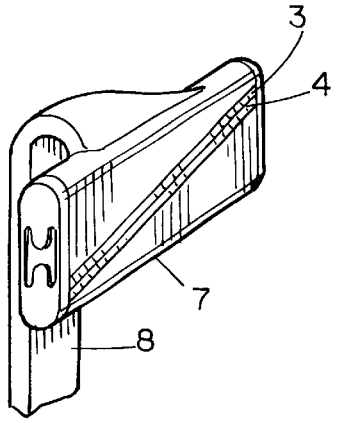
Figure 1C:
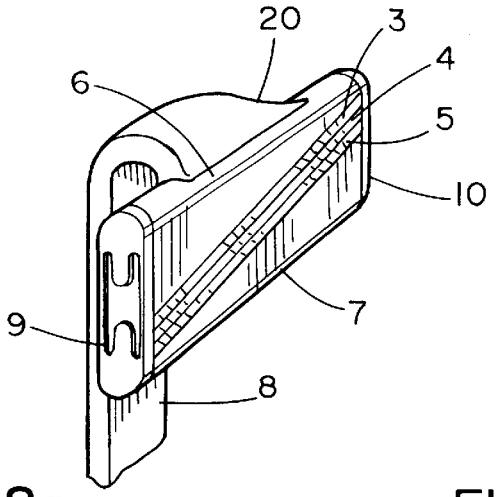

My invention relates to a handheld razor assembly 1 for removing hair. More specifically, my invention relates to a razor head with at least one single-edge for cutting or doubled edged(for cutting) blade positioned at an angle. As seen in FIGS. 1(*a*), 1(*b*), 1(*c*), single edged blade 3 or multiple singled edged blades 3,4,5 in razor head 2 are at an angle from the lower longitudinal 7 side of rectangular razor head 2. This alignment differs from prior art in which singled edged or doubled edged razor blade(s) 3,4,5 or 35*a*, 35*b*, 35*c* respectively, are parallel to longitudinal sides 6,7 of rectangular razor head 2. Please see FIG. 1(*a*). The preferred shape of razor head 2 in my invention is rectangular, but, other shapes of razor head 2 are also within the scope of my invention.

Figure 5A:
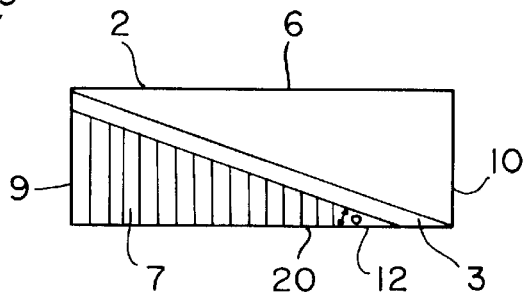
FIGS. 5(*a*) and 5(*b*): Front plan view of razor head with two possible single blade orientations(handle not seen).
Figure 5B:
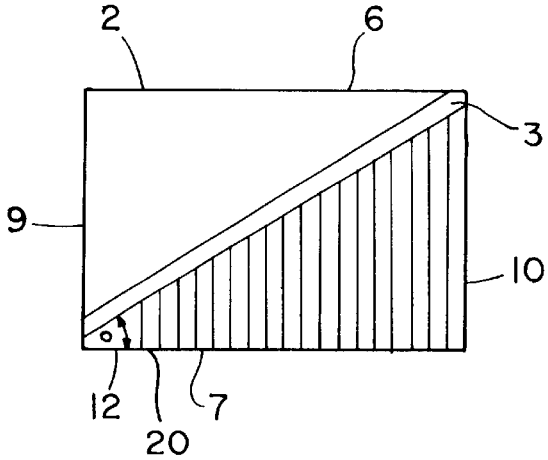

As seen in FIGS. 5*a* and 5*b*, angle 20 is measured from either longitudinal edge 6 or 7. In my invention 1, there is no swiveling motion of razor head 2. My invention 1 is appropriate on any body part, as well as animals such as cats and dogs. However, my invention 1 is especially adapted for coarsely textured human hair such as beards.

Preferred Embodiment

Figure 2A:
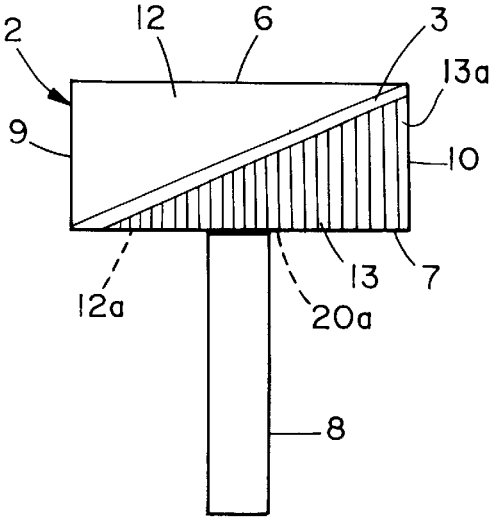
FIG. 2(*a*): Front view of razor head with one singled edged angled blade and safety guard.

Referring to FIG. 2*a*, width 9,10 of razor head 2 is approximately ⅝ inch 9, or 10, and its length is approximately 1 and ¾ inches 6, or 7 in the preferred embodiment. The most preferred angle of orientation of blade(s) 3,4,5 or 35*a*, 35*b*, 35*c* is approximately 20 degrees from the lower or upper longitudinal transverse edge 7. In the preferred embodiment, every 3 is trapezoidal and has only one edge designed and beveled for cutting hair(hereafter single-edged trapezoidal razor blade. Please see FIG. 6*b*. This trapezoidal singled edged blade 3 which forms an angle with either longitudinal edge 6,7 is inserted during the injection molding stage, using methods already well known in the art. However, manually inserted triangular shaped single cutting edged blades can also be used in my invention, if appropriately shaped for insertion into the handheld razor.

Figure 2B:
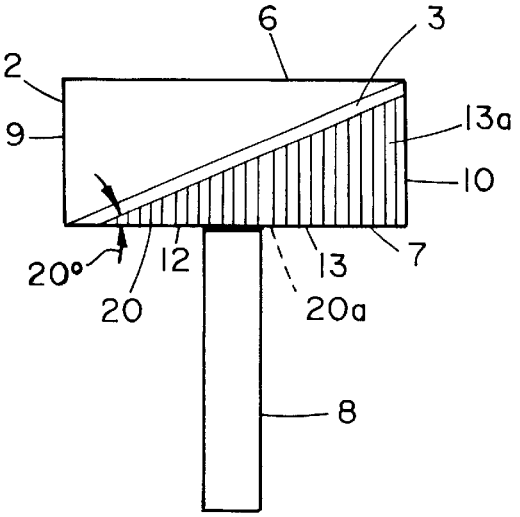
Figure 2E:
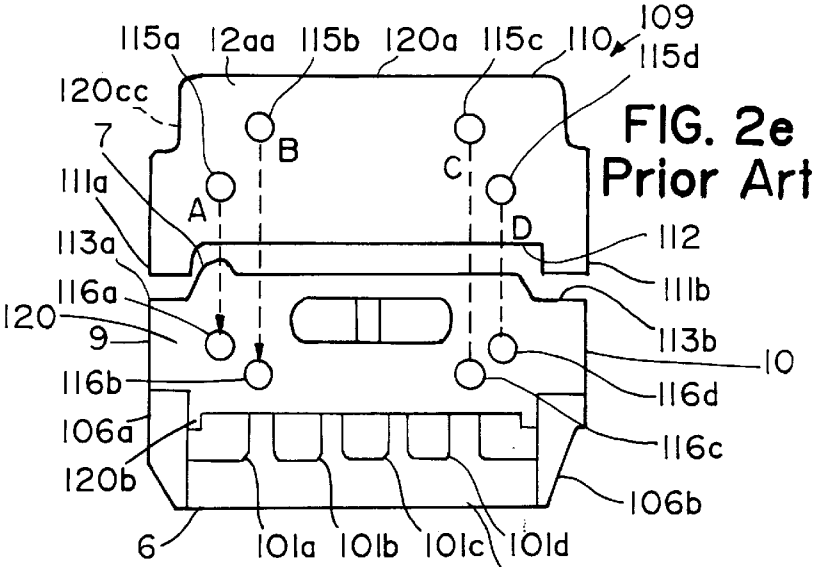
FIG. 2e Prior Art
Figure 2F:
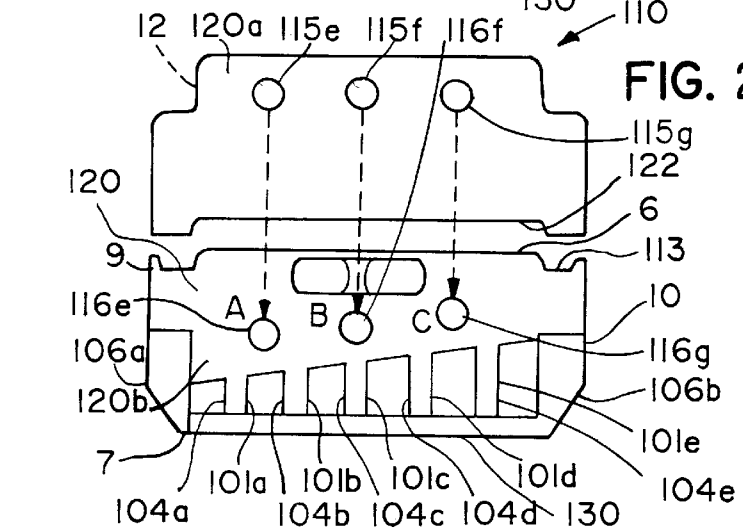

Referring now to FIG. 2*a*, in the most preferred embodiment, razor head 2 has a trapezoidal single-edge blade 3, a guard 13 with grooves 13*a*, two width sides 9,10 and longitudinal edges 6,7. Razor head 2 has an upper surface 12 and a lower surface 12*a*(not seen) in FIG. 2*a*. Handle 8 is integrally attached to razor head 2 at joint 20. In FIG. 2*b*, the most preferred angle 20, as measured from longitudinal side 7 is approximately 20 degrees for a single-edge trapezoidal blade 3.

Figure 2C:
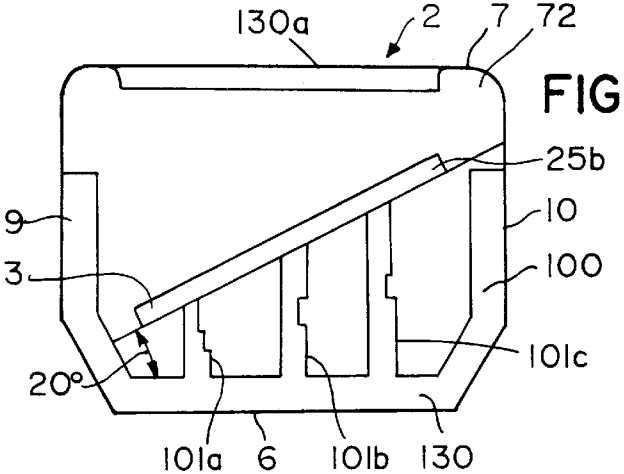
Figure 2D:
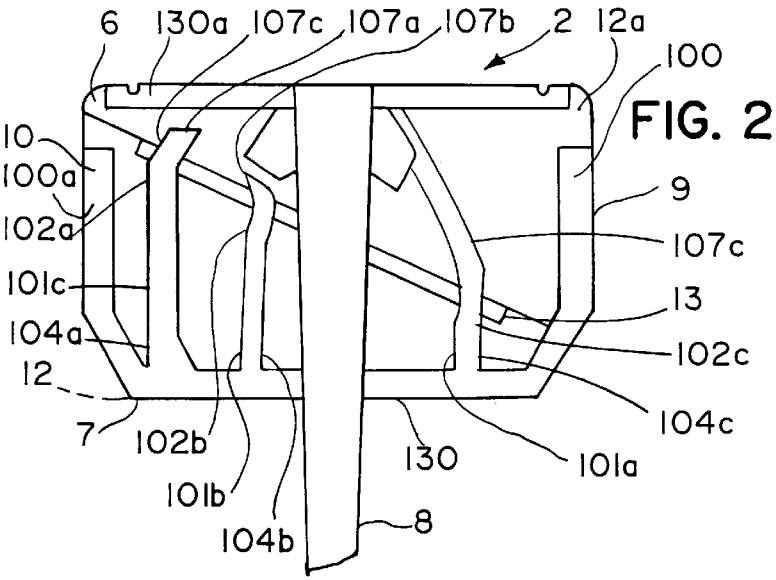
Figure 3A:
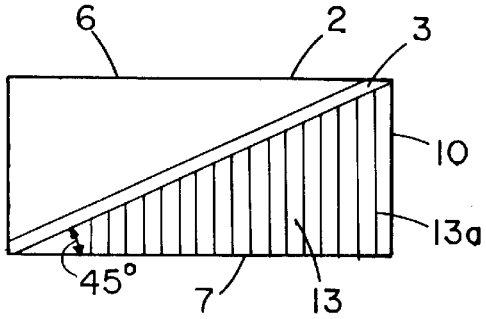
FIGS. 3(*a*) and 3(*b*): Front view of razor head with angle between trapezoidal single edged blade and transverse longitudinal lower edge(handle not seen).
Figure 3B:
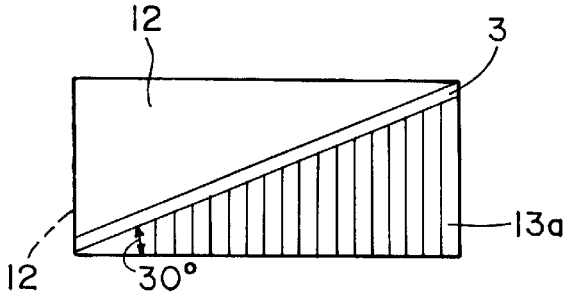

FIG. 2*c* illustrates a top plan view of a rectangular razor head 2 without handle 8. There are longitudinal sides 6,7 from with ridges 130, 130*a* from which the most preferred angle of approximately 20 degrees is measured. Doubled-edged blades 35*a*, 35*b*, 35*c* each comprise two parallel cutting edges 35*c*, 35*d* and each set of cutting edges are joined by central portion 35*e*. Please see FIG. 6*a*. As seen in FIG. 3, a considerable range of angles is acceptable.

Guard 13, which is triangular in two dimensions and adjacent to trapezoidal single-edged razor blade 3, is eliminated from FIG. 2*c* in this cutaway view. Underneath guard 13's location lie support bars 101*a*, 101*b* and 101*c* (generically 101). Suport bars 101*a*, 101*b*, 101*c* extend from ridge 130 to beveled edge 25*b* of one single-edged trapezoidal blade 3. Support bars 101*a*, 101*b*, 101*c* prevent movement or torquing of trapezoidal single-edged razor blade 3.

FIG. 2(*d*) illustrates a posterior view of razor head 2 in the most preferred embodiment including handle 8. The non-beveled edge 25 g of singled-edged trapezoidal blade 3 can be seen within small grips 102*a*, 102*b*, 102*c*(generically 102) comprising each support bar 101, 101*a*, 101*b*, 101*c* respectively. Lower ends 104*a*, 104*b*, 104*c* are integrally attached to ridge 132 along longitudinal side 7. There are side ridges 100, 100*a* along widths 9,10.

Upper ends 107*a*, 107*b*, 107*c* (generically 107) of support bars 101 are integrally attached to lower surface 12*a* after traversing non-cutting edge 25*g* of single-edged trapezoidal blade 3. More or fewer support bars 101 are also within the scope of my invention.

FIG. 2(*e*) is a schematic representation of slot structure 120 within razor head 2 for receiving one single-edged razor blade 3 in the prior art. The two surfaces forming slot 120 are lid 120*a* and lower slot member 120*b*. Razor head 2 is effectively opened as if it were comprised of a lid and a pot. Specifically, lid 120*a* has a lower surface 12*aa* comprising symmetrical downwardly protruding nipples 115*a*, 115*b*, 115*c*, 115*d* (generically 115) which fit tightly into circular indentations 116*a*, 116*b*, 116*c*, 116*d*(generically 116) within lower slot member 120*b*. Corresponding nipples 115*a*, 115*b*, 115*c*, 115*d* and their congruent indentations 116*a*, 116*b*, 116*c* are indicated by arrows A, B, C respectively. There is also ridge 132 along longitudinal edge 6. Hinge members 111*a*, 111*b* fit into sockets 113*a*, 113*b* during the manufacturing process.

FIG. 2(*f*) illustrates the new and most preferred embodiment for slot 120 construction and design for a disposable single-edged trapezoidal blade 3, with integrally attached handle 8. Support bars 101 are present, and there are five support bars 101*a*, 101*b*, 101*c*, 101*d*, 101*e* in this particular illustration. There is plastic ridge 130 to which support bars 101 are integrally attached at their lower ends 140, 140*a*, 140*b*, 140*c*, 140*d*, 140*e*, generically 140.

Upper ends generically 107, are integrally attached to bottom slot member 120*b* of slot 120. Bottom slot member 120 contains circular indentations 116*a*, 116*b*, 116*c* which closely fit and receive nipples 115*a*, 115*b*, 115*c* protruding downward from lower lid surface 120*aa* of lid 120*a*. Lid 120*a* also comprises the upper surface of original upper surface of original upper surface 12 of razor head 2. Corresponding generic nipples 115 and generic indentations 116 in the preferred embodiment are labeled A, B and C in FIG. 2*f*.

As seen in FIG. 2(*f*), in the invention each trapezoidal single-edge 3 blade has corresponding apertures 150*a*, 150*b*, 150*c* (generically 150), through which nipples 115*a*, 115*b*, 115*c* traverse to reach indentations 116*a*, 116*b*, 116*c*. Single-edge trapezoidal blade 3 rests upon bottom slot member 120*b*, and between bottom slot member 120*b* and lid 120*a* in the most preferred disposable embodiment. FIG. 6(*b*) shows a full front view of the most preferred trapezoidal razor blade 3 with appropriately spaced circular apertures 150*a*, 150*b*, 150*c* lying within a straight line.

The preferred embodiment with singled edged blades 3,4,5, is entirely disposable. The most preferred embodiment is comprised of an appropriate rigid plastic, such as any grade of polystyrene (razor head 2 and handle 8). However, for embodiments which are not completely disposable, materials such as tungsten steel are also satisfactory.

Other embodiments can be comprised completely or partially of light metals such as aluminum, stainless steel or spring steel. These materials can be purchased from:

Ceramic materials:

Hammil and Gillespie, Inc., Livingston, N.J.

For spring steel, stainless steel and tungsten steel:

Sanford Materials Company 120 West Third Ave. Suite 1110 San Mateo, Calif. 94402-1503

Figure 4:
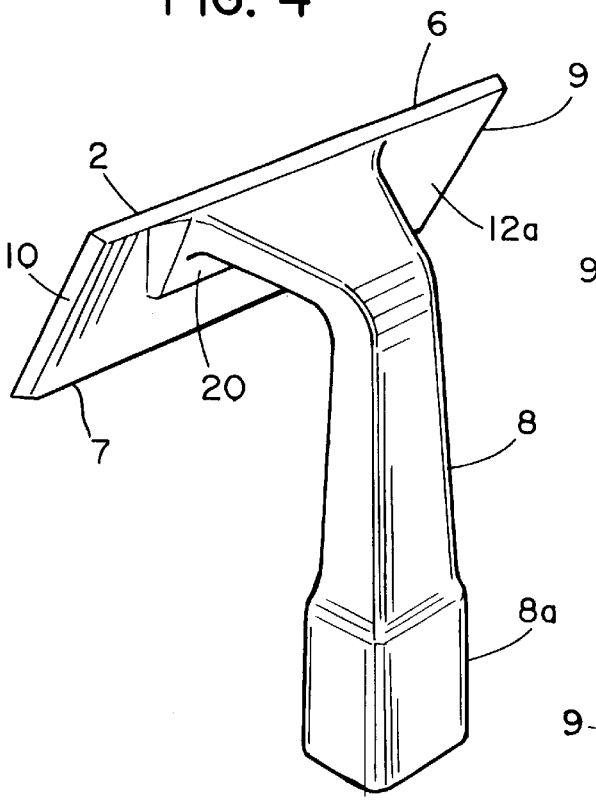
FIG. 4: Partial posterior view of most preferred razor head on handle.

In the preferred embodiment razor head 2 and handle 8 are one piece plastic and produced in a single mold by a process well known to those skilled in the art. In other embodiments 2 razor head 2 is detachable and interchanges with handles 8. Handle 8 has an indented grip 8*a* in the preferred embodiment, as seen in FIG. 4. Particularly for plastic embodiments, razor head 2 can be adapted to existing molds because the dimensions of razor head 2 can vary and remain within the scope of my invention.

Figure 6A:
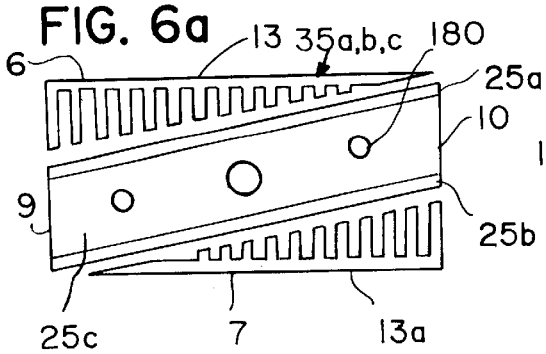
FIG. 6(*a*): Upper plan view of double-edged razor blade with two guards.

As seen in FIG. 6*a* the most preferred embodiment comprises one trapezoidal single edged cutting blade 3. Most preferably there is one single edged trapezoidal blades 3 within razor head slot 120 angled at approximately 20 degrees from longitudinal edge 6 or 7.

FIG. 4 also illustrates integral joint 20 on posterior side 12*a* of razor head 2 where razor head 2 joints handle 8.

Referring now to FIGS. 2*a*, 2*b* and 3 there is a triangular section beneath the angled beveled cutting edge 25*a* of a single-edged trapezoidal blade 3 known as a guard 13.

Polane® is a B/T Polyurethane enamel with a specific gravity of 0.85 to 1.39 and a boiling range of 174 to 395 degrees Fahrenheit. Its evaporation rate is slower than either and its vapor density is heavier than air. Polane® is a two-componet polyurethane which needs to liquid copoyomers to react to room temprature for the final resin to be applied as a coating.

In the preferred embodiment of preformed disposable razor heads and integral handles, Polane® can be sprayed on cured plastic products. However, Polane® can also applied to metal. In addition, guard 13 may comprise Bakelite®, which is a phenolic resin well adapted for coatings on metal and thus is suitable for guard coatings in metal embodiments, discussed infra.

In my invention, Bakelite® coats the metal substrate base of guard 13, which is an integral portion of razor head 2. Bakelite includes resins with a cure with temperatures ranging from approximately 350 degrees Fahrenheit (117 degrees Centigrade) to 400 degrees Fahrenheit(204 degrees Centigrade). The curing process also has dwell times frang-ing from approximately ten to twenty minutes. Very thin films (0.1 ml.) may be cured in less. Cured polyacrylate resins with smooth surfaces or ceramic materials are also satisfactory. These materials are well known to those skilled in the art, as well as their modes of application to a plastic or metal surface.

Referring again to FIG. 2*a*, guard 13 can also be comprised of a metal surface with grooves 13*a* carved or molded within. Guard 13 comprises grooves 13*a*, which are preferably approximately 0.3 inch in length and 0.05 inch in depth. Grooves 13*a* are parallel to each other and sides 9,10; there are approximately twenty grooves 13*a* per guard 13. Grooves 13*a* can also be applied to a resin or ceramic surface by methods well known to those skilled in this particular art.

Guard 13 assists in preventing trapezoidal or triangular single-edged blade(s) 3,4,5 or double-edged rectangular blades 35*a*, 35*b*, 35*c* from disengaging from razor head Guards 13 also assist in preventing inadvertent nicks and cuts. Invention 1 includes embodiments without guards 13, or with variations of guards 13. Guard 13 is also consistent with multiple single-edge trapezoidal blades within a razor head 2. The invention also includes a prototype with two guards 13 which prevents double-edged blade(s) 35*a*, 35*b*, 35*c* from disengaging from razor head 2. Please see discussion infra.

As seen in FIG. 4, attachment 20*a* between handle 8 and razor head 2 should not twist or swivel. In this manner my novel razor head 2 slices and does not drag upon hair roots 29*a*. The preferred material for trapezoidal single edged blades 3, 4, 5 or doubled-edged blades 35*a*, 35*b*, 35*c* is stainless steel. The most preferred combination of razor head 2 and handle 8 comprise a plastic, single molded unit, and is disposable simultaneously with single-edged trapezoidal blade(s) 3, 4, 5.

As seen in FIG. 6(*b*), in the preferred embodiment the actual blade edges for cutting comprise bevels 25*a*, 25*b*. This is true for single-edged trapezoidal blades 3, 4, 5 as well as doubled edged rectangular blades for bevels 25*a*, 25*b* thereon. Bevels 25*a*, 24*b* maximize slicing movement in cooperation with angled blade(s) 3,4,5 or 35*a*, 35*b*, 35*c*.

The angle of trapezoidal razor blade(s) 3,4,5, or double-edged razor blades 35*a*, 35*b*, 35*c* within razor head 2 is most preferably approximately 20 degrees from longitudinal edge 6 or 7. However, a range of approximately 12 degrees to approximately 28 degrees is also satisfactory and within the scope of my invention.

Figure 6B:
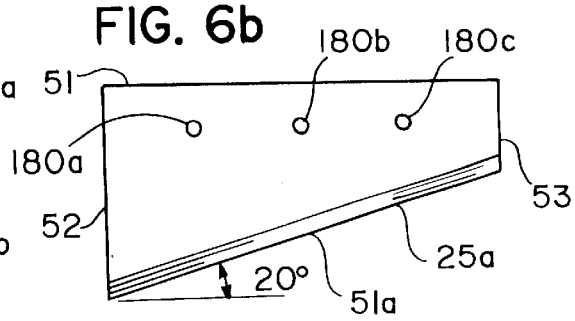
Figure 6C:
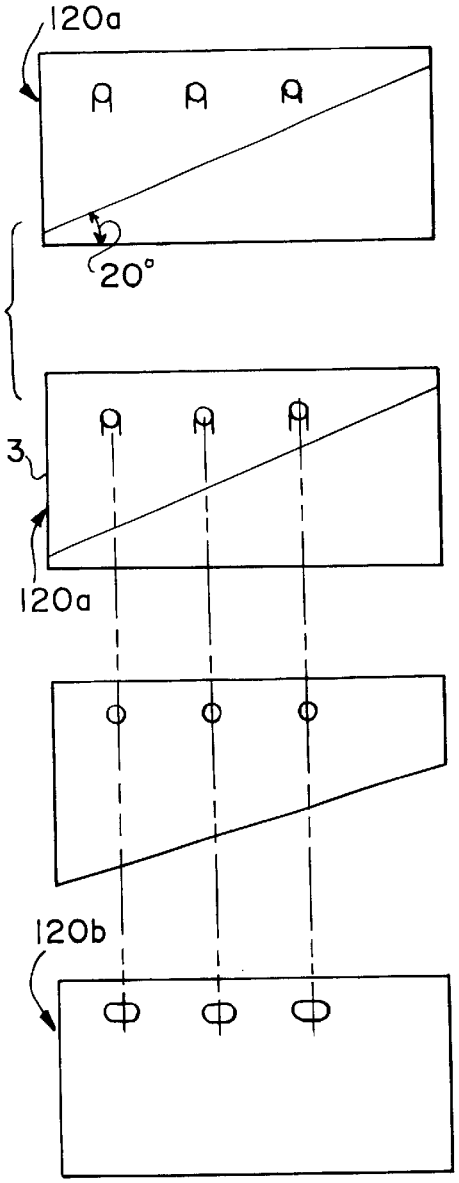

Referring now to FIG. 6*b*, singled edged trapezoidal blade(s) 3, 4, 5 in this embodiment each has a top edge 51 and a bottom edge 51*a* with a bevel 25*a* for shaving. There are also opposite parallel edges 52, 53, thus forming a trapezoidal shape for each singled edged blade(s) 3,4,5. Trapezoidal sing-edged razor blade(s) 3, 4, 5 are actually precut at an angle at the intersection of edges 51, 53. This angle must be complementary to the approximately 20 degree angle from a longitudinal edge, generally approximately 70 degrees. Cutting of blades for razor heads 2 is a well-known process to those who are skilled in this particular art.

Referring to FIGS. 9(*a*),9(*b*), whenever blade(s) 3, 4, 5 or 35*a*, 35*b*, 35*c* are placed or cut within razor head 2 at any angle up to approximately 45 degrees, there will be a slicing effect. The larger the angle up to approximately 45 degrees from either horizontal edge 6 or 7, the more slicing effect will occur. Referring to FIG. 9*b*, hair 29 is sliced by angled blade(s) 3,4,5(seen) or 35*a*, 35*b*, 35*c*(not seen here).

In most prior art a blade parallel to longitudinal edges 6,7 will pull or scrape along the skin surface, as shown schematically in FIG. 9(*b*). A completely horizontal blade parallel to longitudinal sides 6,7 does not slice but merely presses downwardly to cut and scrape, and often slides from hair 29. As seen schematically in FIG. 9(*c*), angled blade(s) 3, 4, 5, or 35*a*, 35*b*, 35*c* slices completely through hair 29—there is no scraping of skin or sliding from hair 29.

Second Embodiment

Figure 7A:
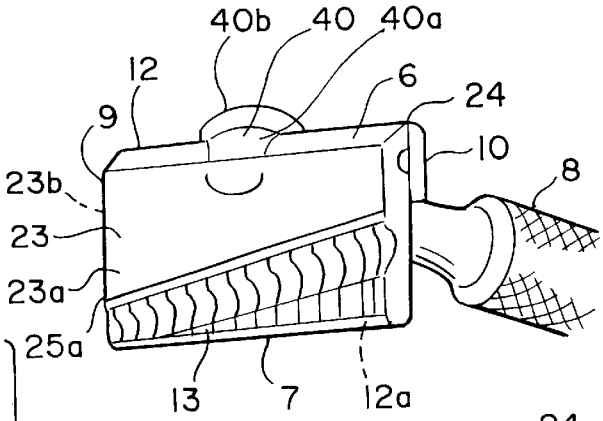
FIG. 7(*a*): Partial plan view of trapezoidal singled edged blade within razor slot at an angle of 20 degrees from longitudinal edge and hinge.

As seen in FIG. 7*a* a second embodiment of my invention comprises a spring member 40 on edge 6 of razor head 2. Spring member 40 is an device by which a blade cover 23 can open or close.

Figure 7B:
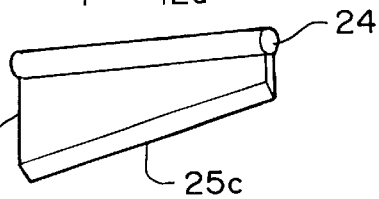

FIG. 7*b* illustrates single edged trapezoidal blade 3 within blade covers 23 comprising its own hinge mechanism 24 and/or spring member 40.

Again referring to FIG. 7*b*, trapezoidal single-edged blade 3 has one side cut and beveled so that the cutting edge is 20 degrees from longitudinal edge 7 of razor head 2. Again referring to FIG. 7(*a*), razor head 2 also comprises blade cover 23. Blade cover 23 is controlled by a spring member 40 and a cylindrical hinge 24. Blade cover 23 in its resting position tightly covers trapezoidal single-edged blade(s) 3,4,5.

Blade cover 23 holds them tightly in place within and between upper razor head flat surface 23*b* (not seen) and blade cover 23. Blade cover 23 is lifted by manually pressing spring components 40*a* and 40*b* together. Blade cover 23 is then raised on the connected cylindrical hinge 24 and trapezoidal singled edged blade(s) are released. Manual release of spring component 40*a* allows blade cover 23 to return to its original position upon flat razor head surface 23*f*. Spring member 40*b* is rigidly fixed and does not move; instead it acts as a lever, when pressed by the operator's opposing finger.

Blade cover 23 is a safety feature, even if razor head 2 is manufactured separately from handle 8. Blade cover 23 closes or opens by cylindrical hinge 24 in cooperation with spring member 40. Blade cover 23 has a top curved surface 23*a* and a bottom curved surface 23*b*. Top and bottom curved surfaces 23*a*, 23*b* are approximately 0.75 inch in thickness and approximately 1 and ⅛ inches in length 6,7.

Spring member 40*a* is attached to upper surface 23*a* of blade cover 23. To remove single-edged trapezoidal blade(s) 3, 4, 5 the user presses one finger upon spring member 40 and towards fixed spring member 40*b* manually. Please see FIGS. 7*a*, 10*a*, 10*b*.

Single edged blade(s) 3,4,5 are released from pressure of blade cover 23, pressure downward upon spring member 40*a* lifts blade cover 23 along cylindrical hinge 24. The user then manually removes blade(s) 3, 4, 5.

Third Embodiment

My third embodiment comprises one or more double-edged rectangular blades 35*a*, 35*b*, 35*c* which are removable from a reusable razor head 2 and handle 8. As seen in FIG. 6*a*, interiorly and between beveled blade edges 25*a*, 25*b* is central segment 25*c*, an integral component of each double-edged blade(s) 35*a*, 35*b*, 35*c*. For a double-edged razor blade 35*a* as seen in FIG. 15*a*, two guards 13*b*, 13*c* are necessary in each razor head 2.

Rectangular doubled-edged blade 35*a* is orientated at angle of approximately 20 degrees from either longitudinal side 6 or 7 of razor head 2. Please see FIGS. 15*a*, 15*b*. Razor head 2 attaches to handle 8 with screw-like member 191, not seen from these views.

Rectangular doubled edged blade(s)35*a*, 3*b*, 35*c* are each approximately 1 and ⅞ inches in length 6,7 and approximately 1 inch in width 9, 10.

Figure 15A:
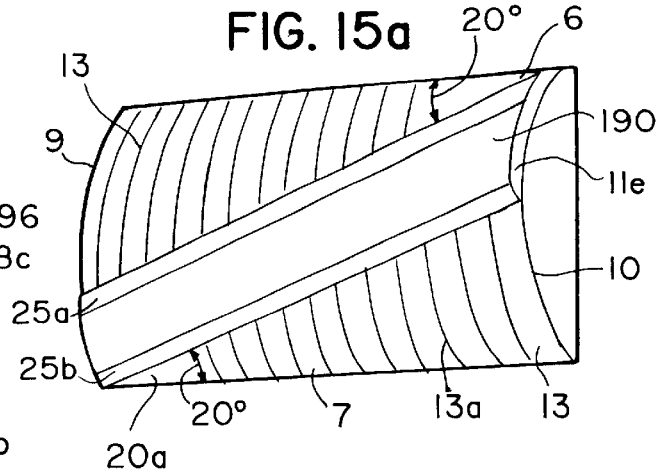
FIG. 15(*a*): Upper partial plan view of single rectangular double-edged razor blade with two guards and shield.

As seen in FIG. 15*a*, shield 190 rigidly covers physically integral central portion 25*c* of one or more rectangular double-edged razor blade(s) 35*a*, 35*b*, 35*c*. Beveled blade edges 25*a* and 25*b* are visible in FIG. 15*a*. Shield 190 with rectangular double edged blade 35*a* immediately lying beneath, is oriented at a 20 degree angle from longitudinal sides 6 and 7 for each blade beveled edge 25*a* and 25*b*. Immediately adjacent to and below each beveled blade edge 25*a* or 25*b* is a triangular guard 13 comprising grooves 13*a*. Ceramics or other materials and methods for characterizing guard 13 are similar to those discussed for the most preferred embodiment supra.

Figure 15B:
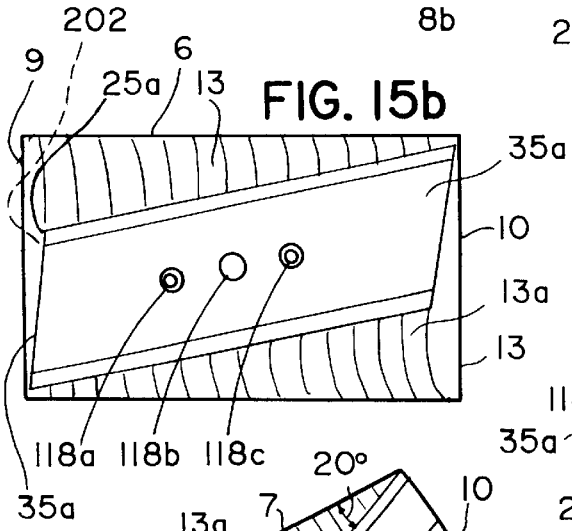

FIG. 15*b* is a top plan view of razor head 2 without handle 8, and shield 190 removed. One sees rectangular double-edge blade 35*a* which lies immediately beneath shield 190 in razor head 2. Three circular apertures 118*a*, 118*b*, 118*c* (generically 118) lie in a straight line at the midline of rectangular doubled-edged razor blade 35*a*. Middle circular aperture 118*b* has a greater diameter than apertures 118*a*, 118*c*. Circular apertures 118*a*, comprise approximately the same diameter as the other. More or fewer circular apertures 118 are also within the scope of my invention.

Circular apertures 118 penetrate both upper and lower surfaces 201, 202 of rectangular double-edged razor blade 35*a*.

Figure 15C:
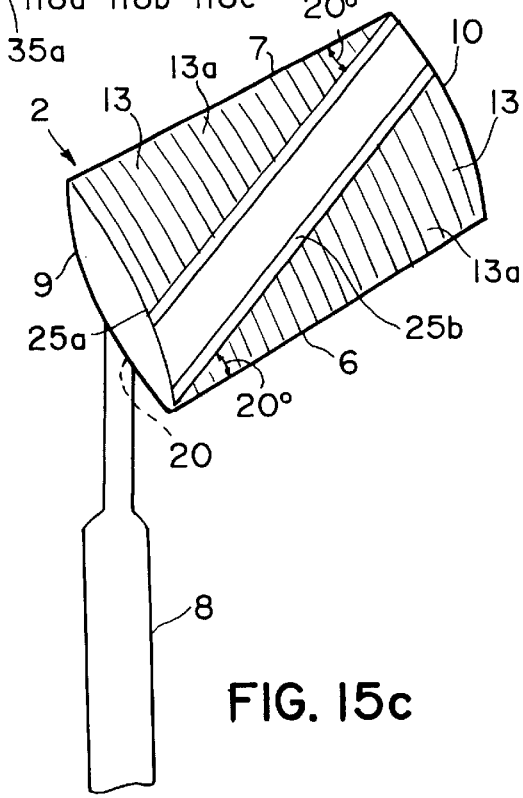

FIG. 15*c* illustrates single rectangular double-edge blade 35*a* in partial front view in relationship to non-disposable handle 8 and attached at joint 20*a*(not see here) to razor head 2. Rectangular double-edged blade 35*a* is oriented at approximately a 20 degree angle to either longitudinal edge 6,7. This feature differs from singled-edge trapezoidal blade 3 which is precut to form the required angle.

Figure 15D:
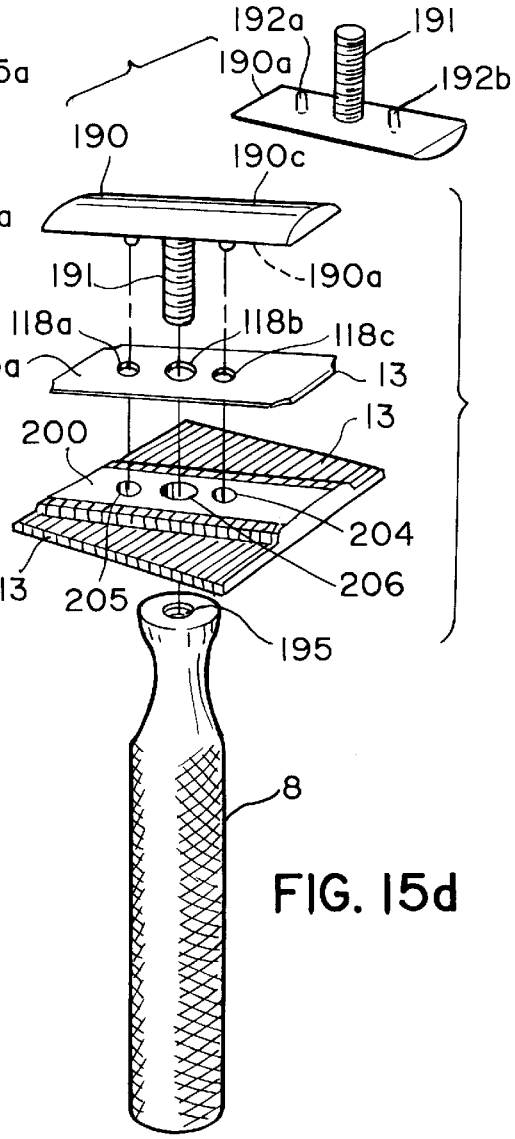

FIG. 15*d* illustrates how disposable double-edge rectangular blade 35*a* is aligned at a 20 degree angle from longitudinal edges 6, 7. Shield 120 has an upper surface 190*c* and a lower surface 190*a*. Lower surface 190*a* comprises two downwardly protruding nipples 192*a*, 192*b*, and screw like member 191.

Screwlike member 191 penetrates aperture 118*b* in doubled edged rectangular razor blade 35*a* while nipples 192*a*, 192*b* penetrate adjoining apertures 118*a*, 118*c*. Screwlike member 191 penetrates upper slot surface 200 and exits through lower surface 12*a* by aperture 206 of razor head 2. Screwlike member 191 continues on to rigidly but reversibly insert into threaded aperture 195 within handle 8.

After penetrating apertures 118*a*, 118*c* in rectangular double-cutting edge razor blade 35*a* nipples 192*a*, 192*b* enter indentations 118*d*, 118*e* respectively in upper surface 200. In upper surface 200, nipples 192*a*, 192*b* are reversibly but firmly secured within indentations 118*d*, 118*e* by rotating screwlike member 191 firmly into handle 8.

Fourth Embodiment

The fourth embodiment of this invention 1 comprises more than one, singled-edged trapezoid blade. As in the most preferred embodiment, each singled-edged trapezoidal blade(s) 3, 4, 5, is precut to an angle of approximately 20 degrees as measured from longitudinal side 6 or 7. Slot 120 is also structure as in the most preferred embodiment.

Figure 8A:
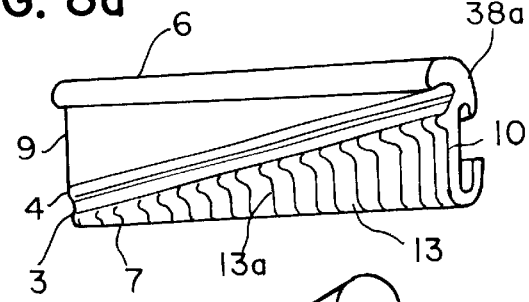
FIG. 8(*a*): Partial upper plan view of razor head containing two singled-edged trapezoidal razor blades.

Referring now to FIG. 8*a*, razor head 2 comprises two single edged trapezoidal razor blades 3,4 which fit within slot 120(not seen). Razor head 2 also has two curved end covers 38*a*(seen) and 38*b*(not seen from this view). Blade(s) 3,4 are precut into razor head 2 to form an angle of approximately 15 degrees to approximately 20 degrees with longitudinal edge 6,7. Orientation for this acute angle can be from either longitudinal side 6 or longitudinal side 7, as in the preferred embodiment.

Figure 8B:
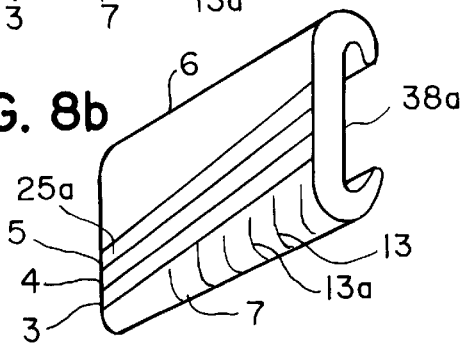

FIG. 8*b* shows three single-edged trapezoidal blades in this embodiment. Razor head end covers 38*a*, 38*b* (not seen) are separate components, which however, rigidly physically attach to either end 9,10 of razor head 2. Razor head end covers 38*a*, 38*b* lock in and secure single-edged trapezoidal blade(s) 3,4,5, and prevent inadvertent nicks or cuts. As seen in front view in FIG. 11, guard 13 is below and adjacent to, and physically attached to adjacent and covers vertical support space bars 61, 62, 63.

Beveled blade edges 25*a* of each single-edged trapezoidal blade(s) 3,4,5, are exposed except those portions within end covers 38*a*, 38*b*. As seen in FIG. 11, vertical support space bars 61, 62, 63 are visible. Each vertical space support bar 61, 62, 63 is comprised of tungsten steel or spring steel.

FIG. 12 illustrates one two curved end pieces 38*a* of razor head 2. Curved end pieces 38*a* and 38*b* are protective caps on each width end 9,10 of razor head 2 when razor head 2 is detachable and disposable, but the handle is reusable. As seen in FIG. 12, each vertical space support bar 61, 62, 63 maintains an opening 66 of approximately 0.10 inch between blades 3 and 4 in this particular illustration. More or fewer vertical space support bars are also within the scope of my invention. Doubled edged rectangular razor blades 35*a*, 35*b*, 35*c* are also within the scope of this embodiment of my invention.

Vertical space support bars 61, 62, 63 are also located in this particular illustration between blades 3,4 as well as between trapezoidal single-edged blade 3 and longitudinal edge 6. Again referring to FIG. 12, vertical space support bars 61, 62, 63 are approximately 0.25 inch in height and approximately 0.05 inch in width. FIGS. 8*a* and 11 illustrate two blades 3,4 unlike FIG. 8*b* which illustrates three blades 3,4,5.

Each vertical space support bar 61, 62, 63 also comprises: an upper end 170*a*, a lower end 170*b*, an anterior surface 170*c* and a posterior surface 170*d*(not seen in FIG. 12)

FIG. 12 illustrates my fourth embodiment, with guard 13 not shown in partial cutaway view. One sees blades 3,4 and frame 67. Frame 67 is located posteriorly to vertical space support bars 61, 62, 63. Anterior to frame 67, vertical support space bars 61, 62, 63 are parallel to each other and to sides 9,10 in rectangular razor head 2. Vertical support space bars 61, 62, 63 are also integrally connected to frame 67 at each of their lower ends 170*b*.

Referring now to FIG. 13*a* each razor head end cover 38*a*, 38*b* is located at width ends 9,10 of razor head 2. Each razor head end cover 38*a*, 38*b* comprises an upwardly curved upper lip 70 and an upwardly curved bottom lip 71. Two tubular slots 72,73 are formed by each set of upwardly curved lips 70 and 71. Tubular slots 72,73 also comprise longitudinal edges 6,7. Edges 6, 7, turn back on themselves to form central components 74,75 of tubular slots 72,73.

FIG. 13 also illustrates a crimp 64 comprising each vertical space bar 61,62,63 to support singled-edge trapezoidal blades 3,4. Vertical space support bars 61, 62, 63 are in parallel orientation to each other and to width edges 9, 10.

Handle 8 has a shaft 8*b* which is approximately 4.0 inches in length and 0.75 inch in width. As seen i FIG. 13*b*, shaft 8*b* bends at a predetermined angle of approximately 35 degrees and terminates as stem 8*c*. Stem 8*c* comprises a rounded or angled end 8*d*. In one variation of this fourth embodiment, stem 8*c* comprises a transverse aperture 8*e* at terminal end 8*d*. Aperture 8*e* completely penetrates stem 8*c* from its first side 8*f*(shown) to second side 8*g*(not shown).

As seen in FIG. 13*b*, straight segment 80 with first end 81 and second end 82 traverses aperture 8*e*. Segment 80 can be of any shape in cross-section. Segment 80 is attached at first end 81 and second end 82 respectively to prongs 86*a*, 86*b* and 87*a*, 87*b*. Prongs 86*a*, 86*b*, 87*a*, 87*b* as well as segment 80 are comprised of light spring steel or plastic. More preferable is any flexible plastic to comprise prongs 86*a*, 86*b*, 87*a*, 87*b*, and stem 80. Stainless steel or tungsten-thin flexible steel are also satisfactory.

In another variation of this fourth embodiment in FIG. 13*c*, segment 80 and prongs 86*a*, 86*b*, 87*a*, 87*b* are an integral physically contiguous physical component of stem 8*c*. As such this embodiment can be manufactured in one mold by processes well known to those skilled in the art.

Figure 14:
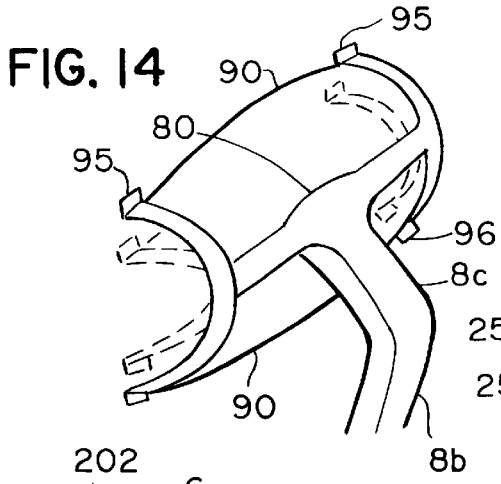
FIG. 14: Posterior view of stem and prongs with spring wires.

Referring again to FIGS. 13*b* and 13*c*, prongs 86*a*, 86*b*, 87*a*, 87*b* and stem 80 are flexible. As a result, there is a snug fit when prongs and stem are manually squeezed into, and then guided though slots 72 and 73. As seen in FIG. 13*c*, prongs 86*a*, 86*b*, 87*a*, 87*c* flex inwardly to insert into slots 72,73 when pressed together to fit into one slot 73,73. Prongs 86*a*, 86*b*, 87*a*, 87*b* then immediately spring back to their original orientation to extent rigid slots 72,73 will allow, thus securing a snug fit of handle 8 to razor head 2. There is no swiveling: prongs 86*a*, 86*b*, 87*a*, 87*b* fit tightly within each respective slot and prevent this unwanted motion. The angle between stem 80 and shaft 8*b* is preferably approximately 30 degrees to approximately 35 degrees. Referring now to FIG. 14, in another variation of the fourth embodiment, there are two spring wires 90*a*, 90*b*. Spring wires have properties which are well known to those skilled in the art. Each spring wire 90*a*,90*b* is tightly attached to upper tips 95,96 respectively of prongs 86*a* and 87*a* and 86*b*, 87*b*.

When prongs 86*a*, 86*b* are initially manually pushed through slots 72, 73, spring wires 90*a*, 90*b* follow within tubular slots 72,73. Spring wires 90*a*, 90*b* enhance a snug, yet easily reversible resilient fit of razor head 2 on handle 8.

My improved angled razor is versatile in that it can be adapted to existing razor heads and/or handles without limitation. The four embodiments presented herein are not intended to be exclusive examples, and all other similar adapations are within the scope of my invention. Manufacturers of razors and others skilled in this particular art quickly recognize the manner in why my angled blades can fit any variation of razor head slot and/or handle.

My angled blades give a smoother safe shave, alone or in combination with my generic guards, on any razor head.

I claim:

1. A hand-held razor, said razor comprising:

(a) a razor head, said razor head further comprising:

(i) a first parallel length and a second parallel length, (ii) a first parallel width and a second parallel width, (iii) a predetermined thickness, said thickness further comprising a top surface and a bottom surface, (iv) at least one slot, said slot extending between said first parallel length and said second parallel length, said slot extending between said top surface and said bottom surface, (v) a single edged razor blade, said single edged razor blade being trapezoidal in shape, said trapezoidal single edged razor blade comprising an angle of approximately 20 degrees from said first parallel length or said second parallel length when inserted within said slot, said razor blade further comprising at least one cutting edge, said cutting edge comprising a bevel, (vi) a guard, said guard comprising a triangular area adjacent said trapezoidal single-edged razor blade, said guard comprising a substance from the group consisting of metal, ceramics, or cured polyacrylates, (b) a handle, (i) said handle having a first upper end and a second lower end, (ii) said first upper end rigidly connected to said bottom surface of said razor head, Whereby said razor head is rigidly attached to said handle so that said razor head containing said angled blade can be manually used to cut hair.

2. The hand held razor as described in claim 1 wherein said razor head is rectangular and comprises one said slot.

3. The hand held razor as described in claim 2 wherein said razor head and said handle are integrally attached and disposable.

4. A hand-held razor, said razor comprising:

(a) a razor head, said razor head further comprising:

(i) a first parallel length and a second parallel length, (ii) a first parallel width and a second parallel width, (iii) a predetermined thickness, said thickness further comprising a top surface and a bottom surface, (iv) at least one slot, said slot extending between said first parallel length and said second parallel length, said slot extending between said top surface and said bottom surface, (v) at least one razor blade, each said razor blade comprising an angle of approximately 12 to 28 degrees from said first parallel length or said second parallel length when inserted within said slot, each said razor blade further comprising at least one cutting edge, each said cutting edge comprising a bevel, (vi) a guard, said guard comprising a triangular area adjacent said razor blade, said guard comprising a substance from the group consisting of metal, ceramics, or cured polyacrylates, (b) a handle, (i) said handle having a first upper end and a second lower end, (ii) said first upper end connected to said bottom surface of said razor head, Whereby said hand held razor containing at least one said angled blade is used to cut hair.

* * * * *